US007163283B2

(12) United States Patent
Loyd et al.

(10) Patent No.: US 7,163,283 B2
(45) Date of Patent: Jan. 16, 2007

(54) REUSE OF SOLVENT STARTUP/SHUTDOWN FLUID FOR CONCENTRATION CONTROL

(75) Inventors: John C. Loyd, Beavercreek, OH (US); James D. McCann, Waynesville, OH (US)

(73) Assignee: Eastman Kodak Company, Rochester, NY (US)

( * ) Notice: Subject to any disclaimer, the term of this patent is extended or adjusted under 35 U.S.C. 154(b) by 169 days.

(21) Appl. No.: 10/970,105

(22) Filed: Oct. 21, 2004

(65) Prior Publication Data

US 2006/0087539 A1 Apr. 27, 2006

(51) Int. Cl.
*B41J 2/175* (2006.01)
*B41J 2/165* (2006.01)

(52) U.S. Cl. ..... 347/85; 347/30

(58) Field of Classification Search ..... 347/7, 347/30, 36, 85, 90

See application file for complete search history.

(56) References Cited

U.S. PATENT DOCUMENTS 3,835,881 A * 9/1974 Dal et al. ..... 137/389
4,067,020 A * 1/1978 Arway ..... 347/7
4,337,468 A * 6/1982 Mizuno ..... 347/7
4,825,228 A * 4/1989 Gloeckler et al. ..... 347/7
5,418,557 A * 5/1995 Pullen ..... 347/7
5,473,350 A * 12/1995 Mader et al. ..... 347/7
5,526,026 A 6/1996 Bowers
5,930,555 A * 7/1999 Lee ..... 399/57

* cited by examiner

*Primary Examiner*—Anh T. N. Vo
(74) *Attorney, Agent, or Firm*—The Buskop Law Group, PC

(57) ABSTRACT

A system to recycle waste ink for reuse as replenishment fluid is for an inkjet print station that includes a printhead with a fluid inlet and a fluid outlet. The system uses an ink supply tank, an external ink supply tank with fresh ink and an ink supply valve to control ink flow from the external ink supply tank to the ink supply tank. The system includes a replenishment fluid supply valve for controlling flow between a replenishment fluid supply and the ink supply tank, a device for monitoring ink concentration in communication with ink, a waste tank and a waste reuse valve for controlling flow between the waste tank and ink supply tank. The system includes level sensors and one or more controllers to control any valves, sensors, and pumps associated with the system to optimize operation of the system.

25 Claims, 2 Drawing Sheets

REUSE OF SOLVENT STARTUP/SHUTDOWN FLUID FOR CONCENTRATION CONTROL

FIELD OF THE INVENTION

The present embodiments relate to methods and system to reuse waste fluid of an ink jet printer. The waste fluid is generated in the start-up sequences, shutdown sequences, and cleaning sequences of an ink jet printer.

BACKGROUND OF THE INVENTION

The concentration of ink in a continuous binary inkjet array printer is typically maintained by replacing the ink vehicle lost due to evaporation with fresh fluids drawn from a dedicated replenishment container. The replenishment fluids used during operation are generally equivalent to the amount of vehicle evaporated from the ink supply during normal operation.

For a continuous solvent-based ink inkjet array printer, solvent based ink fluid is drawn from the replenishment container not only to maintain concentration, but also to flush the printhead and fluid system during startup, shutdown, and printhead cleaning sequences.

In the prior art, the fluids used to flush the printhead and fluid system were then diverted to an external waste tank where the solvent based waste ink was stored until the external waste tank was full. Then, the tank would be manually emptied into a waste collection drum or into a waste collection stream for treatment as a hazardous waste. The fluids used for flushing and the waste ink end up being a significant portion of the total ink consumed by a printer for both flushing and replenishment of the ink vehicle.

A need exists for recovery of waste fluid for an inkjet array printer, particularly one that uses solvent ink or solvent based cleaning fluids to flush the printhead and fluid system during startup, shutdown, and printhead cleaning sequences. A need exists for a system to collect and later reuse the used fluid to replenish ink vehicle lost due to evaporation, to minimizing the total amount of ink consumed and lower the cost of operation of the solvent based ink jet printhead.

The present embodiments described herein were designed to meet these needs.

SUMMARY OF THE INVENTION

The embodied systems and methods are for recovery of waste fluid for an inkjet array printer, which uses ink replenishment fluid flush the printhead and fluid system during startup, shutdown, and printhead cleaning sequences. The method includes steps to collect and later reuse the used fluid to replenish ink lost due to evaporation, thus minimizing the total amount of ink needed by the system.

The system uses a plurality of devices to create a recycle stream of waste ink back into the ink supply. Accordingly, the system uses an ink supply tank and an external ink supply tank with fresh ink in communication with the ink supply tank, an ink supply valve to control flow of ink from the external ink supply tank to the ink supply tank and a replenishment fluid supply that contains a replenishment fluid to replenish fluids lost to evaporation or other causes. The replenishment fluid supply is in communication with the fluid inlet of the printhead and with the ink supply tank. A replenishment fluid supply valve is used to control flow between the replenishment fluid supply and the ink supply tank. A waste tank holds the waste fluid and is in communication with the ink supply tank and the fluid outlet. A device in the system monitors ink concentration and communicates with the waste reuse valve to control flow between the waste tank and the ink supply tank.

The system can utilize a level sensor in the ink supply tank in communication with one or more controllers for optimally controlling the valves, the level sensor for monitoring ink concentration of the system against preset levels and then open and close valves, turn on and off pumps to optimize operation of the system. There is also a method of using the system.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The embodiments herein are for use in a continuous inkjet printer that uses a printhead. In particular, the embodied systems and methods are for use in printheads that use solvent ink to flush the printhead and fluid system during start up, shut down and printhead cleaning sequences. The systems permit the collection and later reuse of the used fluid to replenish fluids lost due to evaporation. The systems minimize the total amount of replenishment fluid used or consumed by the printer thereby producing an ink jet printer that is less expensive to operate, by more than 30% than known printer without this recycle system.

The systems and the accompanying methods are environmentally friendly, as they eliminate the need to manually dispose of waste fluids, which can cause spills, and other hazardous solvent based accidents.

The embodied systems have an environmental benefit because the systems reduce the need to dispose of waste solvents to the environment. This system is a recycling system. The embodied systems are safer for operators to use, due to the reduced need for handling the hazardous materials by a person or through lines that operators are near. By reducing the need to handle these waste fluids, the systems and methods reduce the chance of fire or spillage to the atmosphere or into the ground.

In contrast to current waste fluid handling technique, the embodied methods provide a controlled use of the waste materials while maintaining a consistent and monitored concentration of the ink supply to the printhead. The systems limit variations that can occur in ink jet systems by controlling the type of material recycled, rather than having to adjust more often to new supplies of ink with slight differences in concentration.

The present systems reduce the cost for disposal of waste fluids. The present systems use less replenishment fluid than conventional systems.

Figure 1:
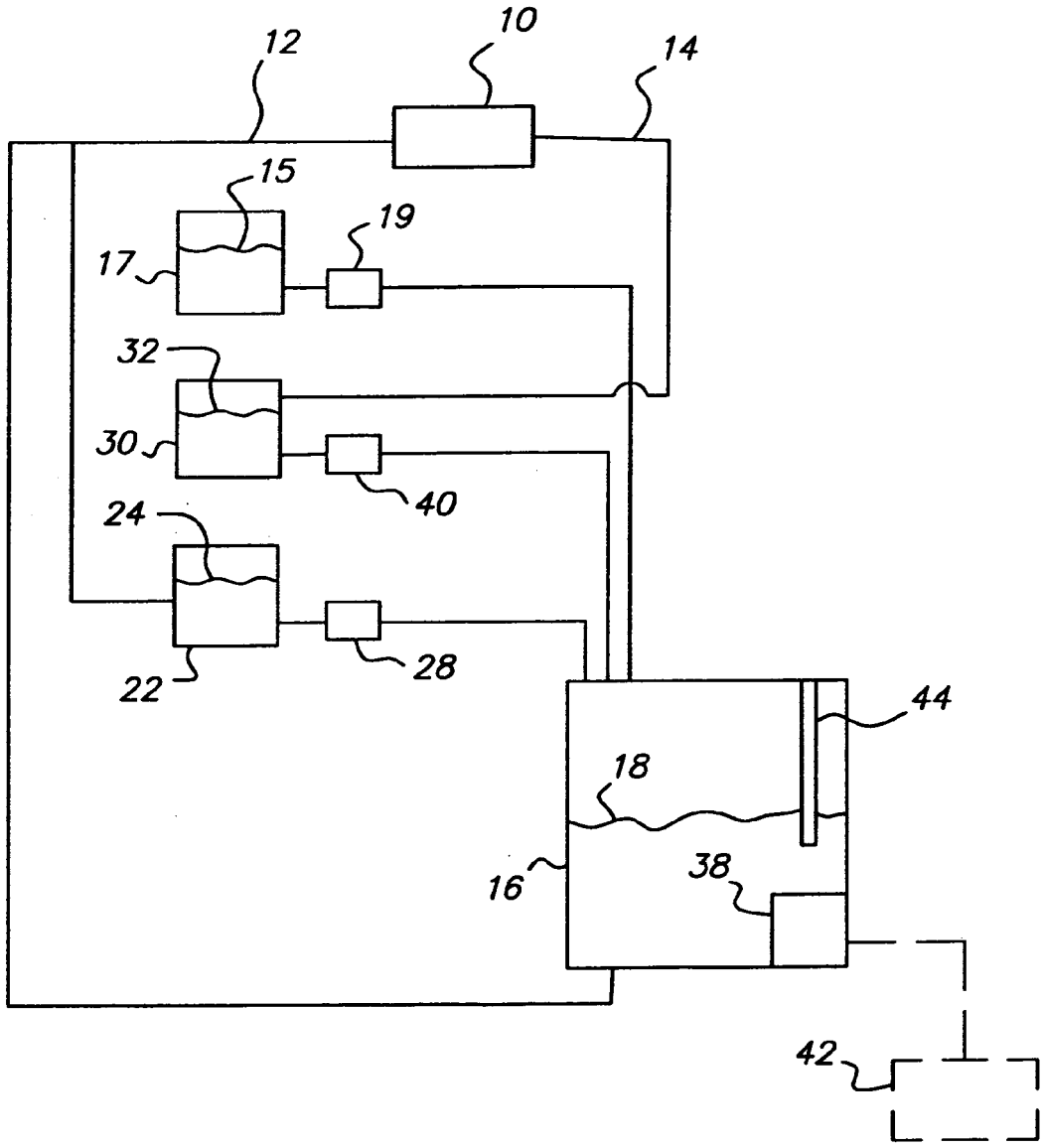
FIG. 1 depicts to the schematic of an embodiment of the fluid system.

With reference to the figures, FIG. 1 depicts an embodiment of a system to recycle ink for reuse as a replenishment fluid or ink supply for an inkjet printer or print station.

The system includes a printhead 10 with a fluid inlet 12 and a fluid outlet 14. A preferred printhead flow rate is 200 ml/minute using 240 jets at 120 jets per inch with an operating pressure of 7½ psi.

The embodied systems are typically used on continuous flow ink jet printers, such as a printhead in a print station number DS 7122 offered by Kodak Versamark™ of Dayton, Ohio. These recycle systems can also be used with on drop on demand printers, such as Model DS 4300 made by Kodak Versamark.

The system uses an ink supply tank 16 to hold solvent based ink 18. Other types of ink can be used with the system, including aqueous based ink, polymer based inks. Typically, the ink supply tank 16 is capable of holding between 1 liter and 6 liters of ink 18, more typically about 1.5 liters of ink 18. The ink supply tank 16 can additionally use an ink level sensor 44. An example of an ink level sensor 44 is a 300 series sensor available from Gems Sensors, of Plainville, Conn.

Figure 2:
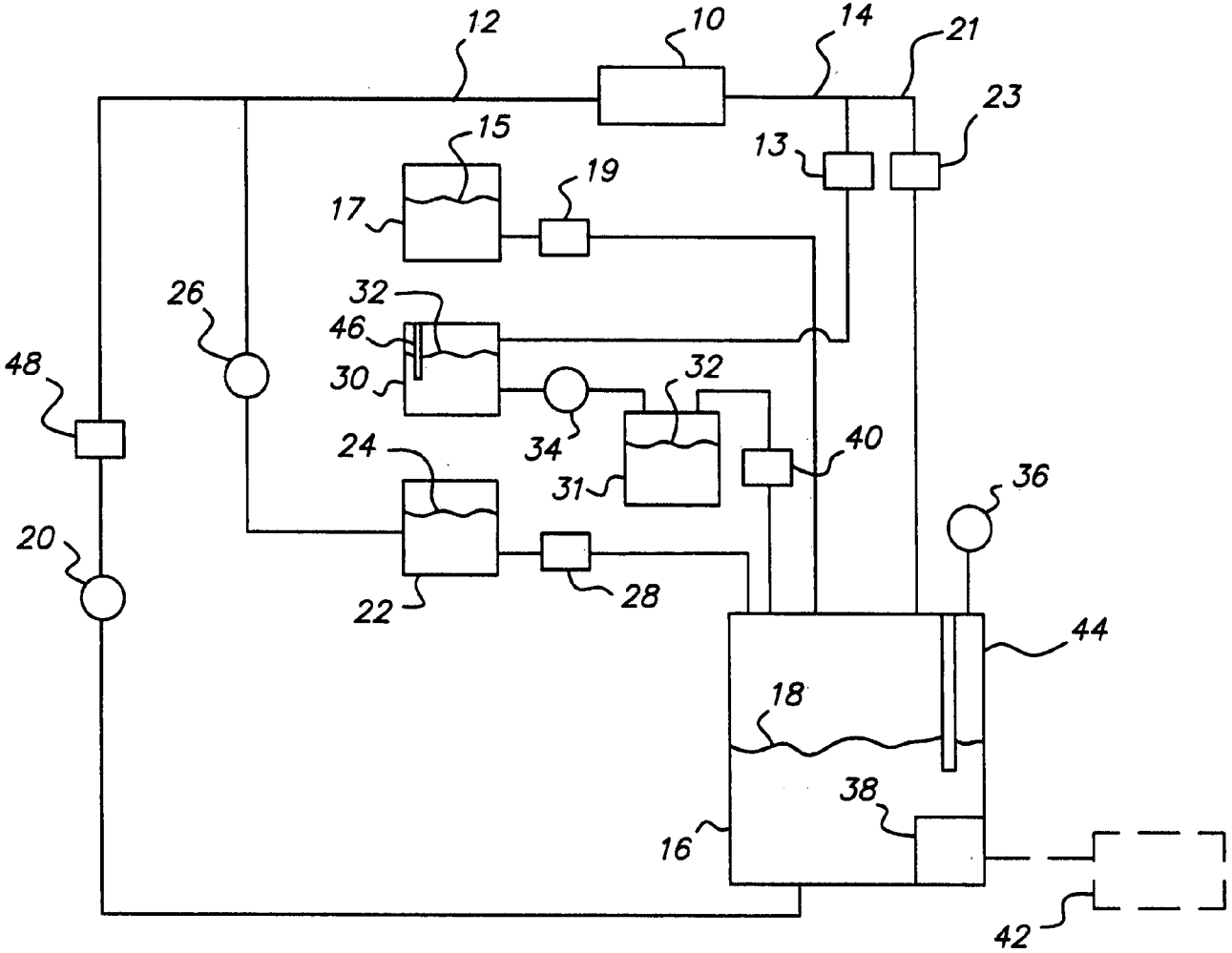
FIG. 2 depicts various alternative parts that can be incorporated into the embodied system depicted in FIG. 1.

Continuing with FIG. 1, the ink supply tank 16 is in communication with the fluid inlet 12 of the printhead 10. The ink 18 can be gravity fed or alternatively supplied using an ink supply pump 20, as shown in FIG. 2. A typical flow rate for the ink supply pump is around 200 ml/min. In supply pumps can be any conventional fluid pump.

An external ink supply tank 17 can be used to hold fresh ink 15. The external ink supply tank 17 can hold between 1 liter and 1000 liters of fresh ink. An example of fresh ink for use in this external ink supply tanks is FD 7101 Black Ink available from Kodak Versamark.

The external ink supply tank 17 is in communication with the ink supply tank 16. An ink supply valve 19 is used to control flow of fresh ink 15 from the external ink supply tank 17 to the ink supply tank 16. The ink supply valve 19 can be a solenoid valve or similar valve, such as those available from Precision Dynamics of New Britain, Conn.

A replenishment fluid supply 22 with a replenishment fluid 24 is connected to the printhead. An example of a usable replenishment fluid 24 is FD 7102 replenishment ink available from Kodak Versamark. Typically, the replenishment fluid supply 22 holds between 1 liter and 1000 liters of replenishment fluid, typically around 20 liters.

Continuing with FIG. 1, a replenishment fluid supply pump 26 can be use to pull replenishment fluid 24 from the replenishment fluid supply 22 to the fluid inlet 12. The replenishment fluid supply pump 26 can be a gear driven pump, a positive displacement pump, centrifugal pump, or diaphragm pump. For example, a 24-volt pump can be used with the systems. The flow rate for the replenishment fluid supply pump can typically be up to 3 liters per minute.

A replenishment fluid supply valve 28, such as a solenoid valve, can be used to control flow between the replenishment fluid supply 22 and the ink supply tank 16.

A waste tank 30 for holding waste fluid 32 is located between the ink supply tank 16 and the fluid outlet 14. The waste tank 30 typically holds between 0.5 liters and 5 liters of fluid.

A device 38 is used to monitor ink concentration in the ink supply tank 16 and the external ink supply tank 17. This device can include an ink concentration sensor can be used to monitor ink concentration. The sensor can be an optical sensor, a viscosity sensor, an electrical resistivity sensor, a printed drop counting system or combinations of these devices. The resistivity of the ink is expected be 430 ohm-cm, as exampled in U.S. Pat. No. 5,526,026, which is incorporated herein by reference.

Continuing with FIG. 1, a waste reuse valve 40 controls flow between the waste tank 30 and the ink supply tank 16. The waste reuse valve 40 can be a solenoid valve or other types of controllable valves usable to control fluid flow. One or more controllers 42 can be used to control optimally the various valves, pumps, sensors and other monitoring devices in order to monitor ink concentration of the system and optimize the operation of the system.

A waste pump 34 can be used to transfer waste fluid from the waste tank 30 to the ink supply tank 16, as depicted in FIG. 2. Examples of waste pumps usable with the system are gear driven pumps, positive displacement pumps, centrifugal pumps, and diaphragm pumps. The pumps usable in these systems can be acquired from Diener Pumps of Zurich, Switzerland. A preferred embodiment of the system incorporates a gravity fed system without any pumps.

A level sensor 44 in communication with the controller can be disposed in the ink supply tank 16. Another level sensor 46 can be used in conjunction with the first level sensor 44 and the controller 42. The second level sensor 46 can be disposed in the waste tank 30. Examples of fluid level sensors are 300 series sensors available from Gems Sensor. Two or more controllers can be used in this system if the controllers are in communication with each other.

FIG. 2 depicts various alternative parts that can be incorporated into the embodied system depicted in FIG. 1 depending on user desires. A filter 48 can be located between the ink supply pump 20 and the printhead 10. A typical filter could be a polymer-based filter with a micron size rating of 0.8 microns to 1.2 microns, such as a polypropylene pleated filter available from Pall of East Hills, N.Y.

In an alternative embodiment, the system could keep all the fluid tanks under vacuum. A vacuum pump 36, as shown in FIG. 2, can be in communication with the ink supply tank 16 to apply negative pressure to the ink supply tank 16. The created vacuum would be expected to be between 12 inches and 15 inches of mercury in order to return waste fluid from the printhead 10 and to draw fluid from the supply sources. Vacuum pumps are readily available, such as from Gast vacuum pumps in Benton Harbor, Mich.

In another alternative embodiment as depicted in FIG. 2, the systems can further include a waste valve 13, such as a solenoid valve, to control flow of waste from the outlet 14 to the waste tank 30 that is in communication with the controller. The systems can include an ink return line 21 between the fluid outlet 14 and ink supply tank 16. The ink return line can be tubing with a ¼ inch to ⅜ inch OD made from a polyimide, such as Teflon™ available from Dupont of Wilmington, Del. Plastic tubing can be used for the ink return line 21 as another alternative. The waste valve 13 can be a three-way valve in communication with the ink return line 21. An ink return valve 23 can be disposed in the ink return line 21 to control the flow of ink between the ink supply tank 16 and the fluid outlet 14.

Preferably, the ink return valve 23 is a controllable valve, such as a solenoid valve or other controllable valve. The ink return valve 23 is in connection with the controller 42. An external waste tank 31 can connect to the ink supply tank 16 and can hold waste fluid 32.

The system can be used when waste fluid is formed from a printhead. The waste fluid then flows into a waste tank. As the waste fluid flows into the waste tank, the amount of ink in the ink supply tank is monitored using a first level sensor. The ink concentration in the ink supply tank is measured using a device to monitor ink concentration and to measure ink concentration. Depending upon the ink concentration and the level of ink in the tank, the controller instructs the system to flow waste fluid into the ink supply tank, or to flow replenishment fluid into the system or fresh ink into the ink supply tank. The replenishment fluid can be a cleaning fluid. Preferably, the replenishment fluid has less than 2% colorant. An example of a useable replenishment fluid is methyl ethyl ketone (MEK).

If the amount of ink in the ink supply tank is low, the controller enables a fluid to flow into the ink supply tank to refill the ink supply tank to the desired amount. The controller determines which fluid to use to refill the ink supply tank based on the measured ink concentration in the ink supply tank.

If the ink concentration in the ink supply tank is less than a first preset concentration value, then fresh ink from an external ink supply tank is flowed into the ink supply tank through ink supply valve.

If the ink concentration in the ink supply tank is over a first preset concentration value and below a second preset concentration value, then waste fluid is flowed into the ink supply tank from the waste tank through a waste reuse valve. For example, the first present concentration value can be set at 100% of normal concentration and the second preset concentration value can be set at 130% of normal ink concentration.

If the ink concentration is greater than the second preset concentration value or if the waste tank is empty, replenishment fluid from the replenishment fluid supply is flowed into the ink supply tank through a replenishment fluid supply valve.

If the fluid level in the waste tank or replenishment tank is too low, the fluid flow through the valves ceases.

The methods can include measuring the waste fluid level in the waste tank with a second level sensor to determine if waste fluid is available for use in the ink supply tank, that is, the level is high enough to flow waste fluid into the ink supply tank. Optionally, ink from an ink supply tank can be filtered before being directed to the printhead that can facilitate the reuse of waste fluid.

Ink can be pumped from the ink supply tank to the printhead with an ink supply pump but the ink can be gravity fed. Replenishment fluid can be gravity fed or pumped into the ink supply tank using a replenishment fluid supply pump. Waste fluid can be pumped from a waste supply tank into the ink supply tank using a waste pump.

A vacuum additionally can be applied to the ink supply tank to create a negative pressure in the ink supply tank to facilitate the sucking in of fluids into the ink supply tank when the valves are opened by the controller.

The embodiments have been described in detail with particular reference to certain preferred embodiments thereof, but it will be understood that variations and modifications can be effected within the scope of the embodiments, especially to those skilled in the art.

PARTS LIST

10 printhead
12 fluid inlet
13 waste valve
14 fluid outlet
15 fresh ink
16 ink supply tank
17 external ink supply tank
18 ink
19 ink supply valve
20 ink supply pump
21 ink return line
22 replenishment fluid supply
23 ink return valve
24 replenishment fluid
26 replenishment fluid supply pump
28 replenishment fluid supply valve
30 waste tank
31 external waste tank
32 waste fluid
34 waste pump
36 vacuum pump
38 device
40 waste reuse valve
42 controller
44 first level sensor
46 second level sensor
48 filter

The invention claimed is:

1. A system to recycle waste for reuse as a replenishment fluid for a inkjet print station, wherein the system comprises:

a. a printhead with a fluid inlet and a fluid outlet;

b. an ink supply tank comprising ink and a first level sensor, wherein the ink supply tank is in communication with the fluid inlet;

c. a replenishment fluid supply comprising the replenishment fluid, wherein the replenishment fluid supply is in communication with the fluid inlet;

d. a replenishment fluid supply valve adapted to control flow between the replenishment fluid supply and the ink supply tank;

e. a waste tank adapted to hold waste fluid, wherein the waste tank is in communication with the ink supply tank and the fluid outlet;

f. a device for monitoring ink concentration in communication with the ink;

g. a waste reuse valve adapted to control flow between the waste tank and the ink supply tank; and h. at least one device adapted to control optimally the valve, the first level sensor, and the device, wherein the controller monitors ink concentration of the system against preset levels and controls the flow of ink to optimize operation of the system.

2. The system of claim 1, further comprising an external ink supply tank comprising ink and an ink supply valve, wherein the external ink supply tank is in communication with the ink tank, and wherein the ink supply valve controls flow of ink from the external ink supply tank to the ink supply tank.

3. The system of claim 1, further comprising a waste valve in communication with the waste tank, wherein the waste valve controls flow of waste fluid from the fluid outlet to the waste tank.

4. The system of claim 3, wherein the waste valve is a three way valve in communication with an ink return line.

5. The system of claim 4, further comprising an ink return valve disposed in the ink return line to control the flow of ink between the ink supply tank and the fluid outlet.

6. The system of claim 1, further comprising an ink supply pump in communication between the ink supply tank and the fluid inlet.

7. The system of claim 1, further comprising an ink return line between the fluid outlet and ink supply tank.

8. The system of claim 1, further comprising a replenishment fluid supply pump adapted to flow replenishment fluid to the fluid inlet.

9. The system of claim 1, further comprising a waste pump adapted to flow waste fluid from the waste tank to the ink supply tank.

10. The system of claim 1, further comprising a vacuum pump in communication with the ink supply tank, wherein the vacuum pump is adapted to apply negative pressure to the ink supply tank.

11. The system of claim 1, further comprising a second level sensor disposed in the waste tank, wherein the second level sensor is in communication with the controller.

12. The system of claim 1, further comprising a filter located between the ink supply pump and the printhead.

13. The system of claim 1, wherein the ink is a solvent-based ink, an aqueous-based ink, a polymer-based ink, a pigment-based ink, or a dye-based ink.

14. The system of claim 1, wherein the replenishment fluid is a cleaning fluid.

15. The system of claim 14, wherein the replenishment fluid comprises less than 2% colorant in the fluid.

16. The system of claim 14, wherein the replenishment fluid is methyl ethyl ketone.

17. The system of claim 1, wherein the inkjet printhead is a continuous ink jet printhead.

18. The system of claim 1, further comprising an external waste tank adapted to hold waste fluid, wherein the external waste tank is in communication with the waste tank and the ink supply tank.

19. A method for recycling waste for use as a replenishment for an inkjet print station, wherein the method comprises the steps of:

i. flushing ink residues from a printhead using a replenishment fluid from a replenishment fluid supply tank forming a waste fluid;

j. flowing the waste fluid into a waste tank;

k. sensing the level of ink in an ink supply tank using a first level sensor;

l. measuring ink concentration in the ink supply tank using a device, wherein the devices monitors and measure ink concentration and determine an outcome, wherein the outcome comprises:

i. the ink concentration in the ink supply tank is less than the first preset concentration value, wherein ink flows from an external ink supply tank into the ink supply tank;

ii. the ink concentration in the ink supply tank is greater than a first preset concentration value and below a second preset concentration value, wherein the waste fluid flows into the ink supply tank from the waste tank;

iii. the ink concentration in the ink supply tank is greater than a second preset concentration value, wherein the replenishment fluid is added to the ink supply tank from the replenishment fluid supply tank; and iv. the waste tank is empty, wherein the replenishment fluid is added to the ink supply tank from the replenishment fluid supply tank.

20. The method of claim 19, further comprising the step of measuring the waste fluid in the waste tank with a second level sensor to determine if waste fluid is available for use.

21. The method of claim 19, further comprising the step of filtering ink from an ink supply tank prior to sending the ink to the printhead.

22. The method of claim 19, further comprising the step of pumping ink from the ink supply tank to the printhead with an ink supply pump.

23. The method of claim 19, further comprising the step of pumping the replenishment fluid using a replenishment fluid supply pump.

24. The method of claim 19, further comprising the step of pumping waste fluid with a waste pump from the waste tank into the ink supply tank.

25. The method of claim 19, further comprising the step of applying a vacuum to the ink supply tank to create a negative pressure in the ink supply tank.

* * * * *

UNITED STATES PATENT AND TRADEMARK OFFICE

CERTIFICATE OF CORRECTION

PATENT NO. : 7,163,283 B2
APPLICATION NO. : 10/970105
DATED : January 16, 2007
INVENTOR(S) : John C. Loyd et al.

It is certified that error appears in the above-identified patent and that said Letters Patent is hereby corrected as shown below:

| | |
|---|---|
| Column 6, Line 40 | In Claim 1, delete "device" and insert -- controller --. |
| Column 6, Line 43 | In Claim 1, after "levels and" insert -- the controller --. |

Signed and Sealed this

Sixth Day of May, 2008

JON W. DUDAS
*Director of the United States Patent and Trademark Office*